US011008805B2

(12) United States Patent
Vander Bent, Jr.

(10) Patent No.: US 11,008,805 B2
(45) Date of Patent: May 18, 2021

(54) ROLL-UP SCREEN PANEL

(71) Applicant: PGT Innovations, Inc., North Venice, FL (US)

(72) Inventor: Kenneth John Vander Bent, Jr., Bradenton, FL (US)

(73) Assignee: PGT Innovations, Inc., North Venice, FL (US)

( * ) Notice: Subject to any disclaimer, the term of this patent is extended or adjusted under 35 U.S.C. 154(b) by 255 days.

(21) Appl. No.: 16/044,028

(22) Filed: Jul. 24, 2018

(65) Prior Publication Data

US 2019/0211623 A1 Jul. 11, 2019

Related U.S. Application Data

(60) Provisional application No. 62/614,672, filed on Jan. 8, 2018.

(51) Int. Cl.
*E06B 9/52* (2006.01)
*E06B 1/04* (2006.01)

(52) U.S. Cl.
CPC ..... *E06B 9/52* (2013.01); *E06B 1/04* (2013.01); *E06B 2009/527* (2013.01)

(58) Field of Classification Search
CPC . E06B 9/521; E06B 9/52; E06B 9/522; E06B 2009/527; E06B 2009/524
USPC ... 160/12, 13, 378, 372, 373, 374, 377, 382, 160/383, 392, 391, 395, 402
See application file for complete search history.

(56) References Cited

U.S. PATENT DOCUMENTS 1,758,720 A * 5/1930 Sodergren ..... E06B 9/52 160/392
2,627,311 A * 2/1953 Kaufmann ..... E06B 9/52 160/395
2,709,489 A * 5/1955 Keeblerpault ..... E06B 9/52 160/381
2,897,889 A * 8/1959 Kessler ..... B07B 1/48 160/392
3,220,469 A * 11/1965 Oehmig ..... E06B 9/52 160/380
3,321,885 A * 5/1967 Pratt ..... A47G 1/0605 52/657
3,552,476 A * 1/1971 Le Tarte ..... E06B 9/52 160/371
3,788,216 A * 1/1974 Lambert ..... B41C 1/14 101/127.1

(Continued)

FOREIGN PATENT DOCUMENTS

GB 2455820 6/2009

OTHER PUBLICATIONS

The Home Depot; Product entitled: "60 in. x 100 ft. Charcoal Fiberglass Screen 18 x 14 Mesh", located at <http://www.homedepot.com/p/Phifer-60-in-x-100-ft-Charcoal-Fiberglass-Screen-18-x-14-Mesh-3003384/100584378>, accessed on Sep. 19, 2017, 5 pgs.

*Primary Examiner* — Johnnie A. Shablack
(74) *Attorney, Agent, or Firm* — Taylor English Duma LLP

(57) ABSTRACT

A screen panel is provided. The screen panel can have a screen frame and a screen mesh positioned over the frame. The screen mesh can be attached to the frame with hooks that can be selectively insertable and removable from the frame. The screen mesh can be attached to a portion of the frame and rolled around itself for shipping, and unrolled and attached to the remainder of the frame for use.

13 Claims, 5 Drawing Sheets

(56) References Cited

U.S. PATENT DOCUMENTS 3,960,197 A * 6/1976 Daniels ..... A47G 1/0605 160/371
4,084,360 A * 4/1978 Reckson ..... E06B 9/52 160/371
4,107,826 A * 8/1978 Tysdal ..... F16B 5/0692 160/395
4,110,003 A 8/1978 Zinn
4,189,880 A * 2/1980 Ballin ..... E06B 3/285 160/380
4,233,790 A * 11/1980 Meadows ..... E06B 3/285 160/395
4,241,487 A * 12/1980 Kraver ..... B25B 27/0092 140/109
4,265,039 A * 5/1981 Brooks ..... G09F 13/04 160/395
4,316,308 A * 2/1982 Chatelain ..... F24S 80/70 24/335
4,453,585 A * 6/1984 Ruggeberg, Sr. ..... F16B 5/0692 160/354
4,539,734 A * 9/1985 Messerschmitt ..... B41F 15/36 160/383
4,566,236 A * 1/1986 Pound ..... A01G 9/1415 52/222
4,662,038 A * 5/1987 Walker ..... F16B 5/0692 160/392
4,665,670 A * 5/1987 van den Burg ..... A01G 9/1415 52/222
4,788,806 A * 12/1988 Sease ..... B44C 7/022 160/395
4,926,605 A * 5/1990 Milliken ..... B63B 17/00 160/392
5,025,604 A * 6/1991 Yeamans ..... E04D 13/1415 52/273
5,039,246 A * 8/1991 Woodruff ..... E06B 9/521 160/392
5,046,546 A * 9/1991 Benedyk ..... E06B 9/521 160/371
5,143,138 A * 9/1992 Zwart ..... E06B 9/521 160/369
5,237,785 A * 8/1993 Lukes ..... E04B 1/5831 160/391
5,242,004 A * 9/1993 Stilling ..... E04B 7/00 160/57
5,301,737 A * 4/1994 Martin ..... E06B 9/52 160/380
5,467,546 A * 11/1995 Kovalak, Jr. ..... G09F 15/0025 160/378
5,586,400 A * 12/1996 Moore, III ..... D05C 9/04 112/103
5,809,709 A * 9/1998 Ryan ..... E04B 9/303 52/222
5,953,873 A * 9/1999 Livingston ..... E04B 9/303 160/391
6,073,376 A * 6/2000 Verret ..... G09F 15/0025 160/378
6,279,644 B1 * 8/2001 Wylie ..... E06B 9/52 160/371
6,314,684 B1 * 11/2001 Aviram ..... E04H 15/646 160/392
6,378,267 B1 * 4/2002 Bass ..... E06B 9/52 160/57
6,779,580 B2 * 8/2004 Woodward ..... E06B 3/302 160/90
6,873,458 B1 3/2005 Bakkom et al.
6,973,953 B2 12/2005 Winner
7,113,332 B1 * 9/2006 Risher ..... G03B 21/56 359/443
7,316,257 B2 1/2008 Cameron et al.
7,619,814 B2 11/2009 Liang et al.
7,936,505 B2 5/2011 Enochs
8,112,849 B2 * 2/2012 Lapouge ..... F16B 5/0692 24/462
8,146,647 B1 * 4/2012 Hughes ..... E06B 9/24 160/371
8,336,266 B2 * 12/2012 Scherrer ..... E04F 13/005 160/327
8,358,464 B1 * 1/2013 Risher ..... G03B 21/56 359/443
8,522,681 B2 * 9/2013 Niswonger ..... B41F 15/36 101/127.1
8,804,239 B2 8/2014 Qingjun et al.
8,997,648 B1 * 4/2015 Niswonger ..... B41F 15/36 101/127.1
9,290,990 B2 3/2016 Hicks et al.
9,366,080 B2 6/2016 Colson
9,482,051 B1 * 11/2016 Green ..... E06B 9/52
10,577,860 B2 * 3/2020 Seuberling ..... E06B 9/52
2004/0020157 A1 * 2/2004 Bass ..... E06B 9/52 52/656.7
2004/0191450 A1 9/2004 McGuinness et al.
2004/0211531 A1 * 10/2004 Dybdahl ..... E06B 9/52 160/377
2006/0157208 A1 * 7/2006 Annacchino ..... E06B 9/52 160/371
2006/0231221 A1 * 10/2006 Chen ..... E06B 9/24 160/392
2007/0119553 A1 * 5/2007 Guffey ..... E04H 3/16 160/371
2009/0159222 A1 * 6/2009 Moriya ..... F16B 5/0692 160/378
2010/0101131 A1 * 4/2010 Lipczynski ..... E06B 7/28 40/745
2012/0073771 A1 * 3/2012 Dickison ..... E06B 9/52 160/395
2020/0173230 A1 * 6/2020 Seuberling ..... E06B 9/52

* cited by examiner

ROLL-UP SCREEN PANEL

CROSS-REFERENCE TO RELATED APPLICATIONS

This application claims the benefit of and priority to U.S. Provisional Patent 62/614,672, filed Jan. 8, 2018, which is incorporated in its entirety in this document by reference.

TECHNICAL FIELD

This disclosure relates to screen panels. More specifically, this disclosure relates to screen panels that can be partially assembled for ease of shipping and installation.

BACKGROUND

Conventional screen panels require screen spline to attach screen mesh to a screen frame. The screen spline must be "rolled" in on the jobsite or in a manufacturing facility using specialized tools and specialized skills. Conventional screens assembled in a manufacturing facility can be expensive to ship and easily damaged because of the size of the assembled screens typically requiring wide, thin rectangular boxes. Conventional screen panels rolled in on the jobsite can be expensive and time-consuming because of the skill required to form an assembled screen.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a screen panel including a screen frame; a screen mesh positioned over the screen frame; and a hook configured to couple the screen mesh to the screen frame.

Also disclosed is a method of shipping a screen panel, the method including: positioning a screen mesh over opposed, spaced frame members of a screen frame; attaching the screen mesh to the opposed frame members; rolling the screen mesh around itself until the opposed frame members are substantially adjacent to each other; and positioning the rolled screen mesh and the opposed frame members in a shipping container.

Also disclosed a method of making a screen panel, the method including: at a first location, positioning a screen mesh over a first pair of opposed, spaced frame members of a screen frame; attaching the screen mesh to the first pair of opposed frame members; rolling the screen mesh around itself until the first pair of opposed frame members are substantially adjacent to each other; shipping the rolled screen mesh that is attached to the first pair of opposed frame members and additional frame members from the first location to a second location that is different than the first location; unrolling the screen mesh until the screen mesh is tight; securing additional frame members between the first pair of opposed frame members to form a continuous rigid frame comprising the first pair and a second pair of opposed frame members; and attaching the screen mesh to the second pair of opposed frame members with a plurality of hooks.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
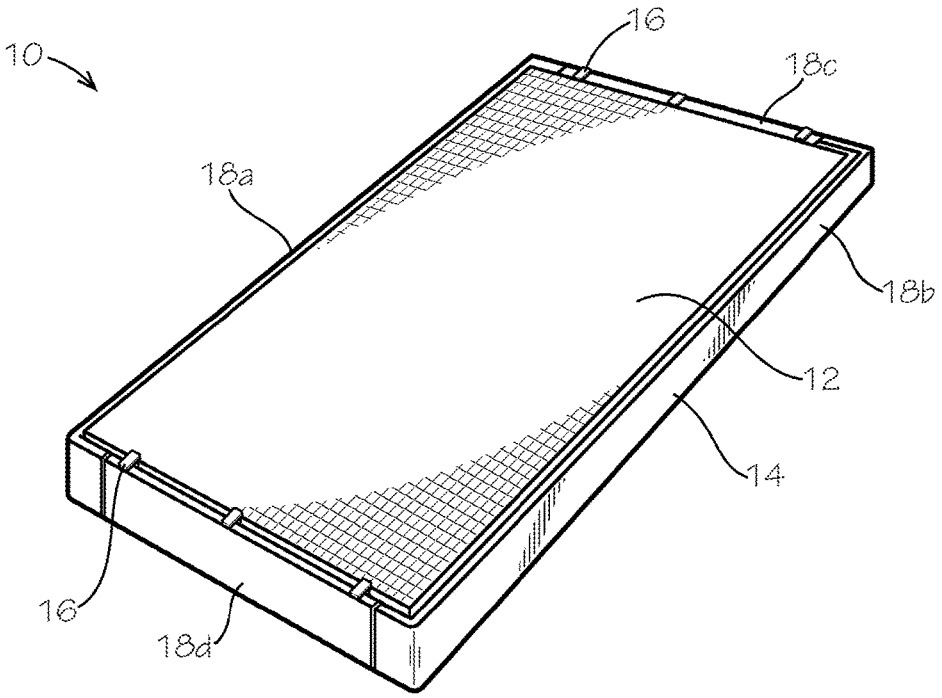
FIG. 1 is a perspective view of a screen panel comprising a screen mesh, a screen frame, and a plurality of hooks configured to couple at least a portion of the screen mesh to the screen frame, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed are screen panels and associated methods, systems, devices, and various apparatus for assembling and shipping the screen panels. The screen panels can be partially assembled at a first location, such as a manufacturing facility, and easily reassembled at a second location, such as a job site, without requiring the use of specialized tools or specialized skills. It would be understood by one of skill in the art that the disclosed screen panels are described in but a few exemplary embodiments among many. No particular terminology or description should be considered limiting on the disclosure or the scope of any claims issuing therefrom.

FIG. 1 shows a screen panel 10 comprising a screen mesh 12, a screen frame 14 and a plurality of hooks 16, according to various aspects. The screen mesh 12 can be a conventional screen mesh 12 made from metallic wire, fiberglass, other synthetic fiber and the like. The screen mesh 12 can be secured to just a portion of the screen frame 14 for shipping and secured to the remaining portions of the screen frame 14 with the plurality of hooks 16 for use.

The screen frame 14 comprises a plurality of elongate frame members 18. As shown in FIG. 1, for example, the screen frame 14 can comprise a left frame member 18*a*, a right frame member 18*b*, an upper frame member 18*c*, and a lower frame member 18*d*. In one aspect, each frame member 18 can be selectively, releasably coupled to at least one other frame member 18 to form the screen frame 14. For example, the frame members 18 can be coupled together with screws, bolts, adhesives, and the like. In another example, the frame members 18 can be coupled together with a friction fit. The frame 14 can be formed from rigid materials. For example, the frame members 18 can be made from wood, from polymeric materials such as nylon and the like, and from metallic materials such as steel, aluminum, and the like, and can be manufactured by extrusion, for example and without limitation.

Figure 2:
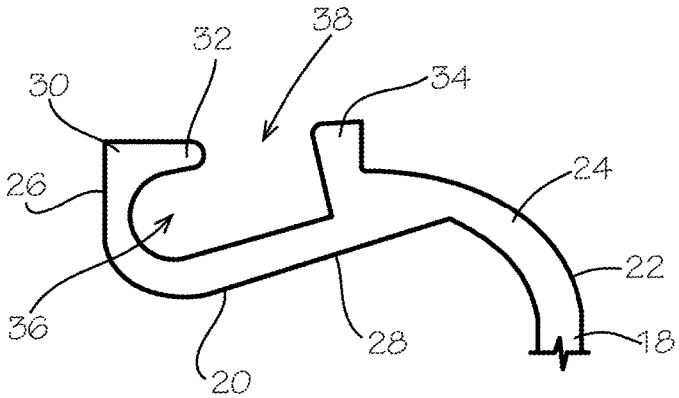
FIG. 2 is a magnified elevational view of a distal end of a frame member of the screen panel of FIG. 1.

Referring now to FIG. 2, each frame member 18 of the screen frame 14 can comprise a frame wall 20 positioned on a distal end 22 of the frame member 18. The frame wall 20 comprises a first end 24, a second end 26 spaced from the first end 24, and a central portion 28 extending between the first end 24 and the second end 26. In one aspect, the first end 24 can be securedly coupled to or formed integrally with the distal end 22 of the frame member 18. In another aspect, a hooked tab 30 can formed on the second end 26 of the frame wall 20. In this aspect, the hooked tab 30 can extend away from the central portion 28 a first predetermined distance such that a hooking element 32 of the hooked tab 30 is spaced from and overlies the central portion 28 of the frame member 18. In another aspect, a locking tab 34 can be formed on the central portion 28 of the frame member 18 a second predetermined distance from the hooked tab 30. In this aspect, the locking tab 34 can extend away from the central portion 28 a third predetermined distance.

In yet another aspect, the hooked tab 30, the locking tab 34 and the central portion 28 of the frame member 18 cooperate to define a locking chamber 36. In this aspect, an opening 38 can be defined between the hooking element 32 and the locking tab 34 to provide access to the locking chamber 36.

Figure 3:
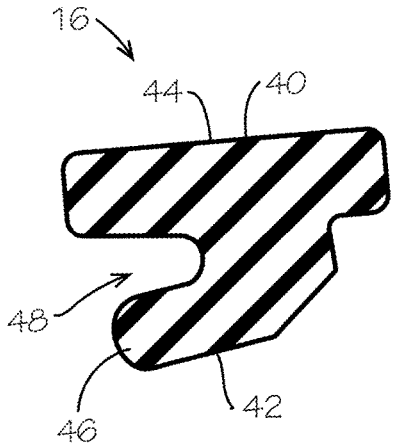
FIG. 3 is magnified elevational view of the hook of the screen panel of FIG. 1.

The hook 16 is illustrated more clearly in FIG. 3, according to one aspect. The hook 16 can be, for example and without limitation, a J-shaped hook. In one aspect, the hook 16 can comprise a substantially planar upper wall 40 and a curved leg 42 extending away from a central portion 44 of the upper wall 40. In one aspect, the curved leg 42 can extend away from the upper wall 40 such that a hooking member 46 of the curved leg 42 is spaced from and overlies the upper wall 40 and a gap 48 is defined between a portion of the curved leg 42 and the upper wall 40. In another aspect, the curved leg 42 can be sized and shaped to correspond to the size and shape of the locking chamber 36 of the frame member 18. Thus, the curved leg 42 can be substantially the same size and shape as the locking chamber 36. Alternatively, the curved leg 42 can be slightly smaller or slightly larger than the size of the locking chamber 36. The hook 16 can be formed from a material such as rubber and the like that can flex and then return to its original shape.

Figure 5:
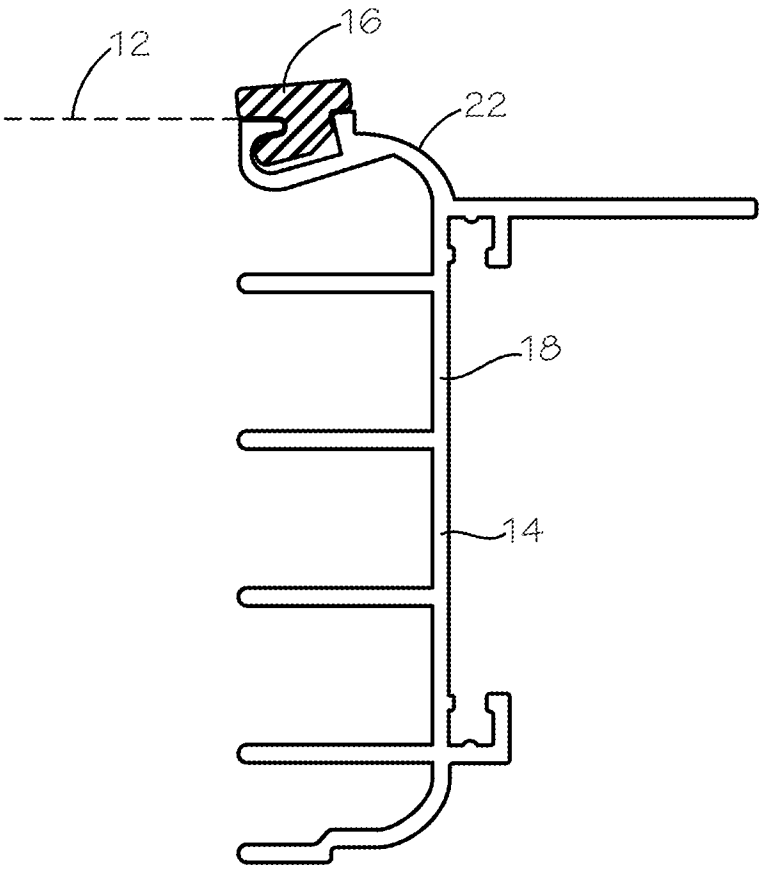
FIG. 5 is a side elevational view of the hook of FIG. 3 coupled to the frame member of FIG. 2 to attach the screen mesh to the frame member.
Figure 4:
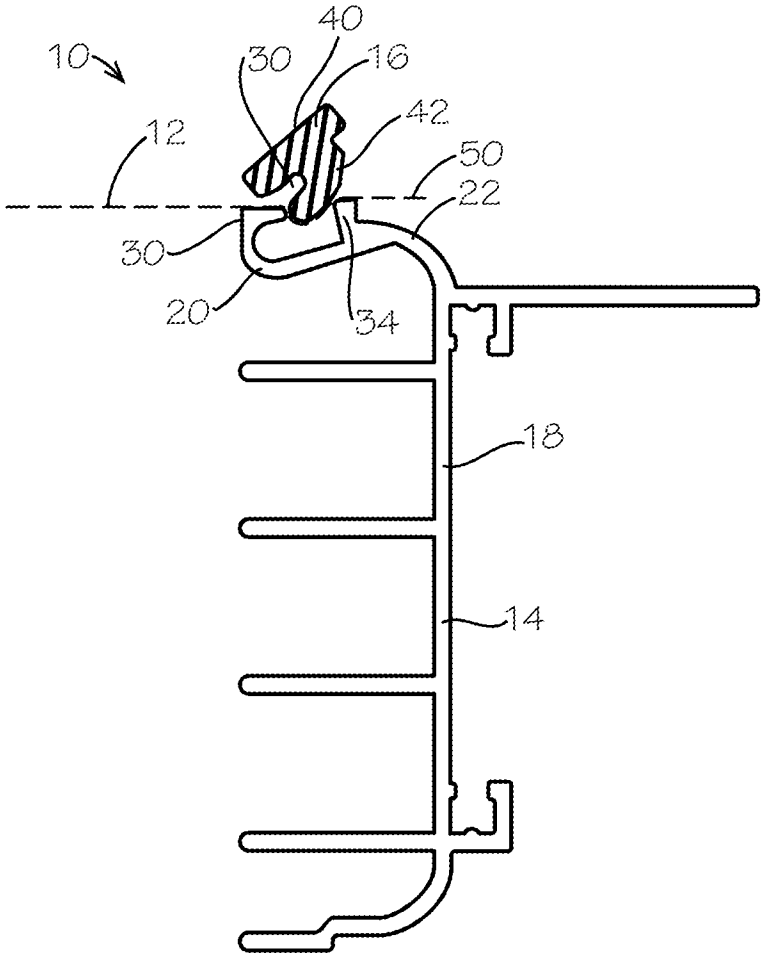
FIG. 4 is a side elevational view of the hook of FIG. 3 being inserted into the frame member of FIG. 2 to attach the screen mesh to the frame member.

FIGS. 4 and 5 illustrate the hook 16 being used to secure or attach the screen mesh 12 to the screen frame 14. In one aspect, a first end portion 50 of the screen mesh 12 can overlie the opening 38 (as shown in FIG. 2) defined between the between the hooking element 32 and the locking tab 34 of the frame wall 20. In some aspects, the first end portion 50 of the screen mesh 12 can extend well past the opening 38 on both sides so that some of the first end portion 50 of the screen mesh 12 can be cut away, such as with a box cutter, once the hook 16 is securely in place attaching the screen mesh 12 to the screen frame 14. The curved leg 42 of the hook 16 can be aligned with the opening 38 and rotatingly inserted into the locking chamber 36, thereby pushing the first end portion 50 of the screen mesh 12 into the locking chamber 36 as well. The curved leg 42 of the hook 16 can be inserted into the locking chamber 36 until the hooking element 32 of the hooked tab 30 is positioned in the gap 48 defined between the curved leg 42 and the upper wall 40. The flex of the hook 16 can allow the curved leg 42 to move past the locking tab 34 before returning to its original shape once positioned in the locking chamber 36. Thus, in one aspect, the hook 16 can easily and selectively be attached to or removed from the screen frame 14 by a user.

With the curved leg 42 positioned in the locking chamber 36, the hook 16 can be in a locked position relative to the frame member 18 of the frame 14. In the locked position, the first end portion 50 of the screen mesh 12 can be pinned between the hook 16 and the frame wall 20 to prevent inadvertent or undesired removal of the screen mesh 12 from the locking chamber 36 and thus from the frame member 18. Friction between the hook 16 and the frame wall 20 can prevent inadvertent or undesired removal of the hook 16 from the frame wall 20. In the locked position, the upper wall 40 of the hook 16 can rest on the hooked tab 30 and/or the locking tab 34 of the frame wall 20.

Figure 9:
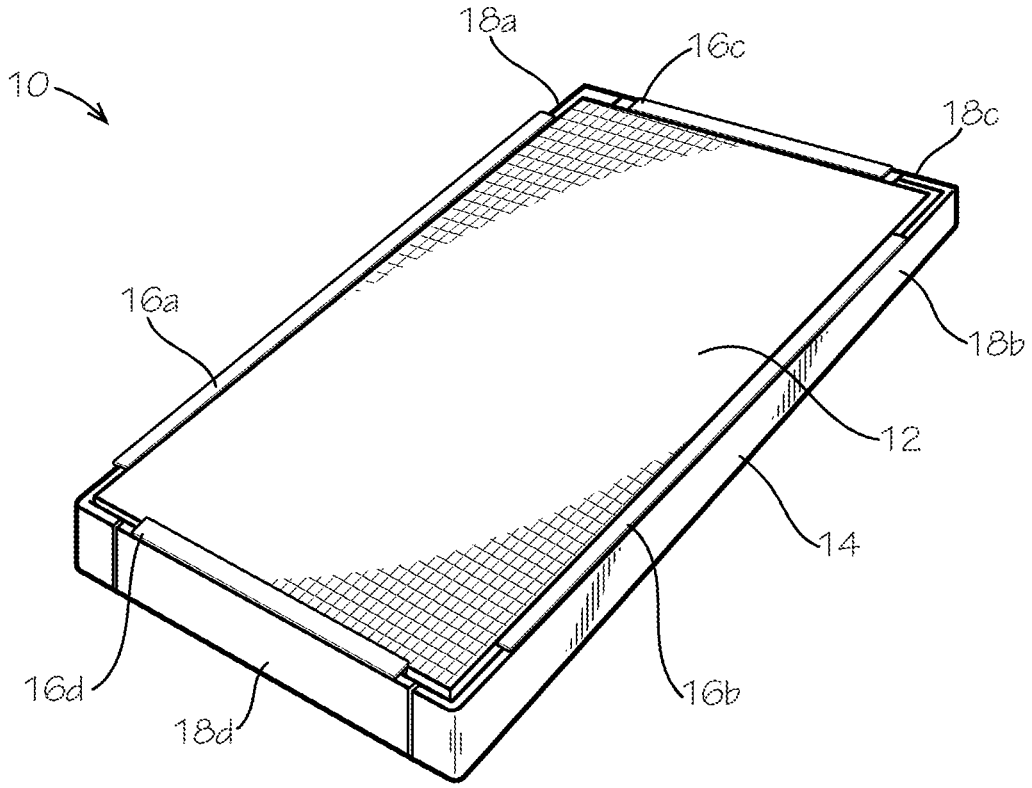
FIG. 9 is a perspective view of the screen panel of FIG. 1 in which the plurality of hooks comprise elongate hooks extending the length of a respective frame member, in accordance with one aspect of the present disclosure.

As can be appreciated, a plurality of hooks 16 can be used to secure the screen mesh 12 along the length of the elongate frame member 18. That is, hooks 16 can be placed a predetermined distance apart along the length of the frame member 18 to securedly couple the first end portion 50 of the screen mesh 12 to the frame member 18 as shown in FIG. 1. Optionally, in some aspects and as shown in FIG. 9, the hooks 16 can take the form of an elongated spline that can be pushed in along a portion of or the entire length of the frame member 18 in the locking chamber 36. That is, in one aspect, each hook 16 can have a hook length substantially equal to or slightly less than a length of a corresponding frame member 18. In this aspect then, each hook 16 can be a continuous single piece that extends along the entire length of a frame member 18. For example, the plurality of hooks 16 can comprise a first hook 16*a* defining a hook length substantially equal to a length of the locking chamber 36 of the left frame member 18*a*, a second hook 16*b* defining a hook length substantially equal to a length of the locking chamber 36 of the right frame member 18*b*, a third hook 16*c* defining a hook length substantially equal to a length of the locking chamber 36 of the upper frame member 18*c*, and a fourth hook 16*d* defining a hook length substantially equal to a length of the locking chamber 36 of the lower frame member 18*d*. In another aspect, each hook 16 can have a hook length less than the length of a corresponding frame member 18.

Figure 8:
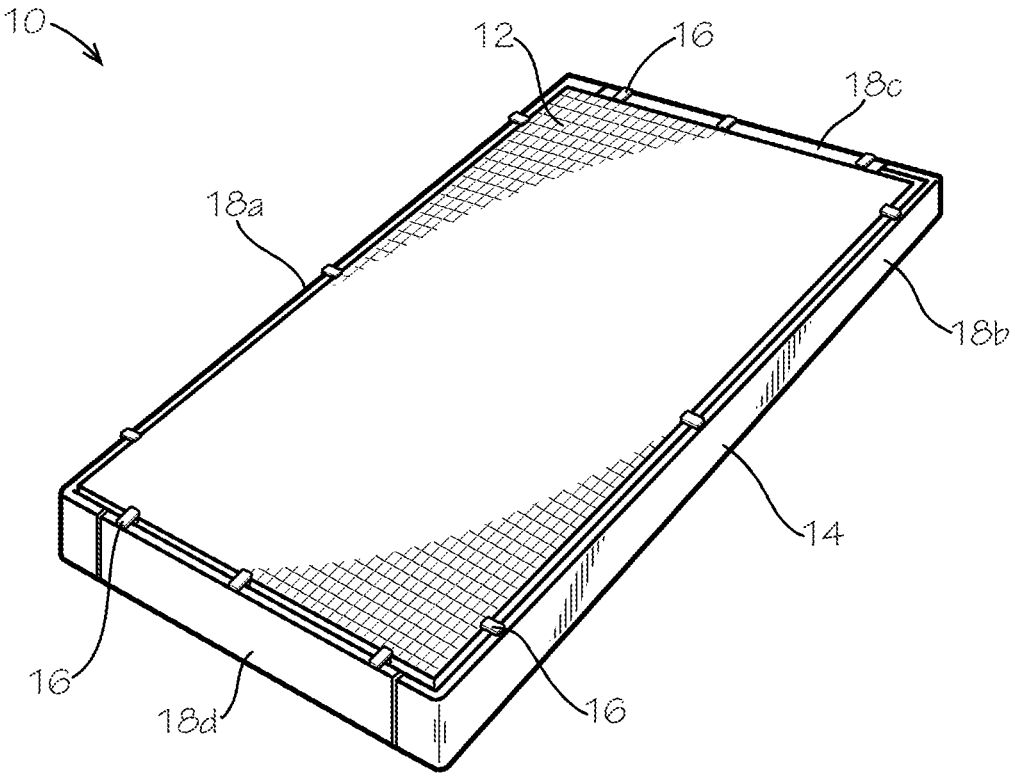
FIG. 8 is a perspective view of the screen panel of FIG. 1, in which the plurality of hooks couple the screen mesh to each frame member of the frame.

To partially assemble the screen panel 10 for shipping at a first location, such as a manufacturing facility, the screen panel 10 can be partially assembled by securing the screen mesh 12 to two opposing frame members 18 of the screen frame 14. For example, the first end portion 50 of the screen mesh 12 can be secured to the left frame member 18*a*, and a second end portion 52 of the screen mesh 12 that is opposed to the first end portion 50 can be secured to the right frame member 18*b* in a similar manner to the first end portion 50. In another example, the first end portion 50 of the screen mesh 12 can be secured to the upper frame member 18*c* and the second end portion 52 of the screen mesh 12 can be secured to the lower frame member 18*d*. In one aspect, for partial assembly of the screen panel 10, the first end portion 50 and the second end portion 52 can be secured to the respective frame members 18*a, b, c, d* with conventional spline and spline installation tools, such as a spline roller and the like. For example and as illustrated in FIG. 1, the screen mesh 12 can be coupled to the left frame member 18*a* with traditional spline, and the screen mesh 12 can be coupled to the right frame member 18*b* with traditional spline. The upper frame member 18*c* and the lower frame member 18*d* can then be coupled to the screen mesh 12 with hooks 16 after shipping of the screen assembly 10. In another aspect, for partial assembly of the screen panel 10, the first end portion 50 and the second end portion 52 can be secured to the respective frame members 18*a, b, c, d* with the plurality of hooks 16 as described above. For example and as illustrated in FIG. 8, the screen mesh 12 can be coupled to the left frame member 18*a*, the right frame member 18*b*, the upper frame member 18*c*, and the lower frame member 18*d* with the plurality of hooks 16 (though for partial assembly, the screen mesh 12 would only be coupled to the left and right frame members 18*a, b*, or to the upper and lower frame members 18*c, d*).

Figure 6:
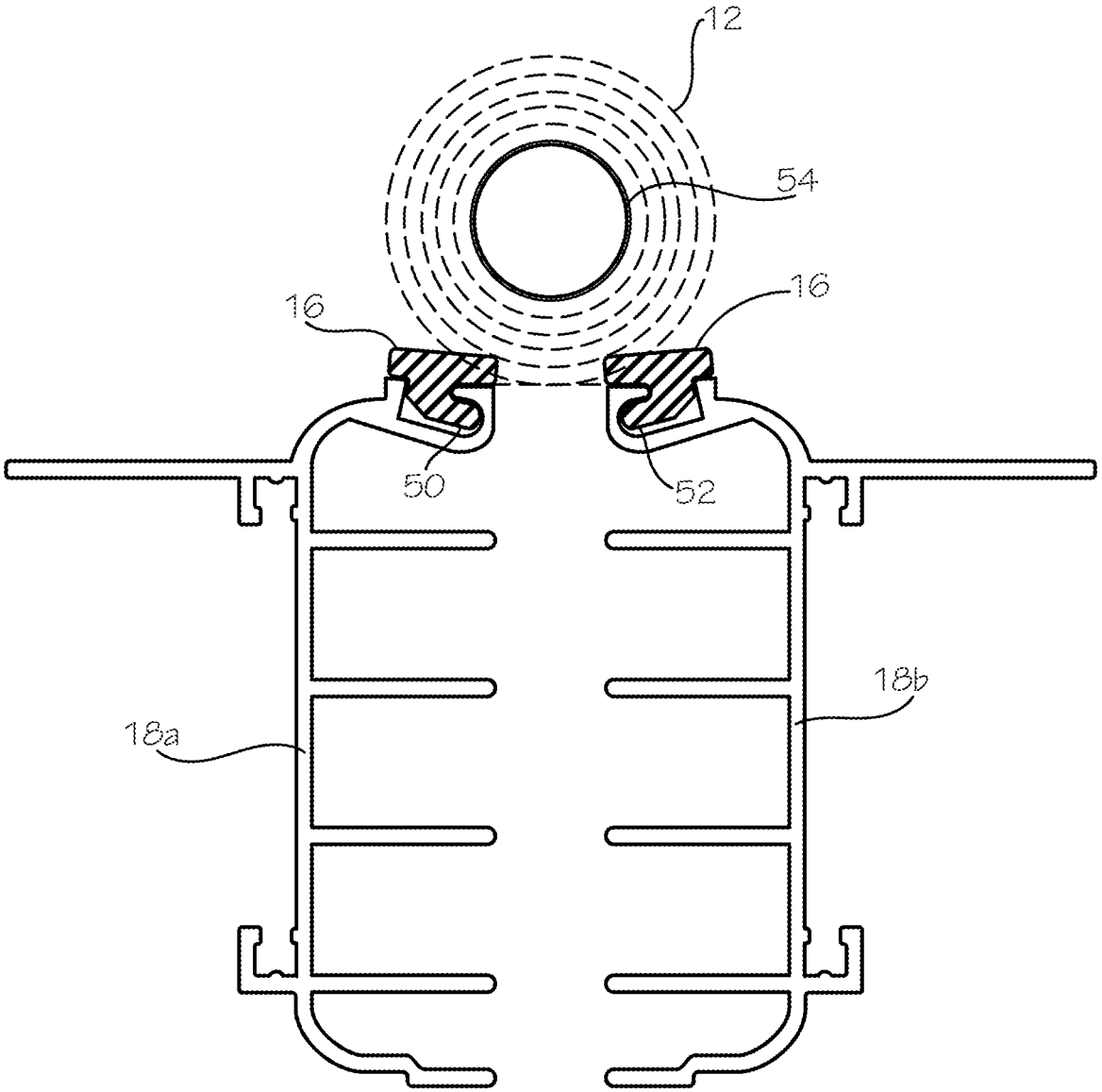
FIG. 6 is a side elevational view of the screen panel of FIG. 1, in which the screen panel has been partially assembled and the screen mesh has been rolled for shipment.

With the first end portion 50 of the screen mesh 12 secured to the left frame member 18*a* and the second end portion 52 of the screen mesh 12 secured to the right frame member 18*b*, or with the first end portion 50 secured to the upper frame member 18*c* and the second end portion 52 secured to the lower frame member 18*d*, the screen mesh 12 can be rolled up as illustrated in FIG. 6. That is, in one aspect, with the screen mesh 12 coupled to a first pair of opposed, spaced frame members 18, the screen mesh 12 can be rolled around itself between the opposed frame members 18. In another aspect, the screen mesh 12 can be rolled around itself between the opposed frame members 18 until the frame members 18 are adjacent to each other. Optionally, the screen mesh 12 can be rolled around itself between the first pair of opposed frame members 18 until the frame members 18 are spaced from each other a fourth predetermined distance. In another aspect, as shown in FIG. 6, the screen 12 can be rolled around a tube 54 to facilitate the rolling process.

Figure 7:
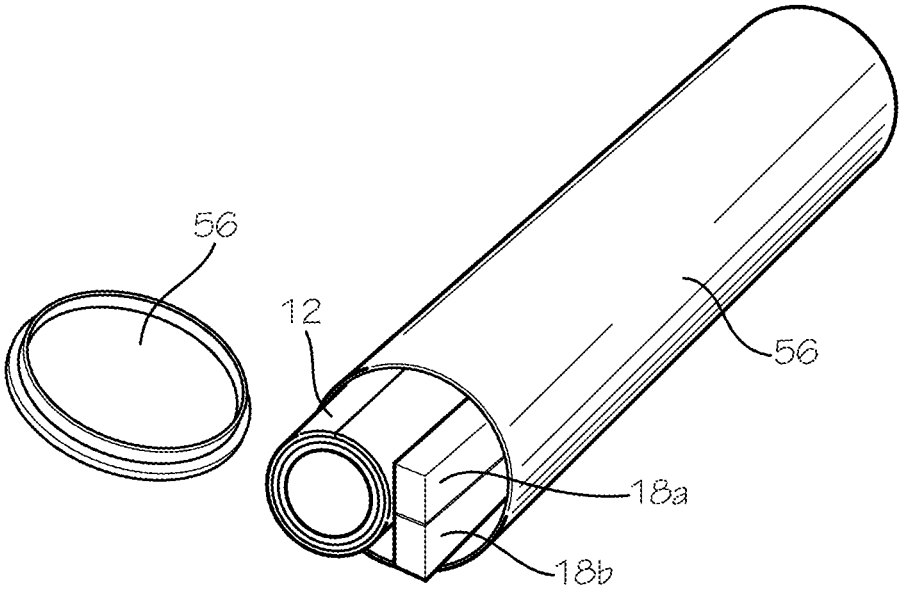
FIG. 7 is a perspective of the partially-assembled screen panel of FIG. 6 positioned in a shipping container.

The partially-assembled screen panel 10 comprising the rolled screen mesh 12 secured to the first pair of opposed frame members 18 can be positioned in a shipping container 56 for shipment to a user, as illustrated in FIG. 7. Any other frame members 18 not already secured to the screen mesh 12 can also be positioned in the shipping container 56 for shipment to a user. Because the shipping container 56 is much smaller and less bulky and unwieldy than conventional containers used to ship preassembled screen panels 10, shipping costs can be much lower for this partially-assembled screen panel 10 than for conventional preassembled screen panels 10.

To finish assembly of the partially-assembled screen panel 10 at a second location that is remote from the first location, such as a job site, the rolled screen mesh 12 secured to the first pair of opposed frame members 18, and any other frame members 18 not already secured to the screen mesh 12 can be removed from the shipping container 56. The screen mesh 12 can be unrolled until the screen mesh 12 is tight between the first pair of opposed frame members 18. The screen frame 14 can be assembled by attaching the additional frame members 18 to the frame members 18 already preassembled with the screen mesh 12 to form a continuous frame 14 comprising the first pair and a second pair of opposed frame members. For example, if the first end portion 50 of the screen mesh 12 was secured to the left frame member 18*a* and the second end portion 52 of the screen mesh 12 was secured to the right frame member 18*b*, the upper frame member 18*c* and the lower frame member 18*d* can be securedly attached to the left frame member 18*a* and to the right frame member 18*b*. In another example, if the first end portion 50 of the screen mesh 12 was secured to the upper frame member 18*c* and the second end portion 52 of the screen mesh 12 was secured to the lower frame member 18*d*, the left frame member 18*a* and the right frame member 18*b* can be securedly attached to the upper frame member 18*c* and to the lower frame member 18*d*.

With the screen frame 14 assembled, the screen mesh 12 can be secured to any additional frame members 18 with the plurality of hooks 16. Thus, if the screen frame 14 has four sides and the screen mesh 12 was previously secured to two sides, the screen mesh 12 can be secured to the remaining two sides of the screen frame 14 with a plurality of hooks 16. As described above, the hooks 16 can simply be pushed into the locking chamber 36 to secure the screen mesh 12 to the frame member 18, thereby making final assembly of the screen panel 10 easy and without the need for specialized tools or skills.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A screen panel comprising:

a screen frame comprising an elongate first frame member and an opposed elongate second frame member, the first frame member defining a first locking chamber and a first opening allowing access to the first locking chamber, the second frame member defining a second locking chamber and a second opening allowing access to the second locking chamber;

a screen mesh defining a first end portion and a second end portion opposite the first end portion, the first end portion positioned over the first opening of the first frame member and the second end portion positioned over the second opening of the second frame member, wherein the screen mesh is configurable in a rolled configuration, wherein the screen mesh is rolled between the first end portion and the second end portion, and an unrolled configuration, wherein the screen mesh is unrolled between the first end portion and the second end portion;

a first hook formed separately from the screen frame and the screen mesh and configured to couple the first end portion of the screen mesh to the first frame member, the first hook defining a first curved leg configured to removably engage the first locking chamber, wherein the first end portion of the screen mesh is sandwiched within the first locking chamber between the first hook and the first frame member; and a second hook formed separately from the screen frame and the screen mesh and configured to couple the second end portion of the screen mesh to the second frame member, the second hook defining a second curved leg configured to removably engage the second locking chamber, wherein the second end portion of the screen mesh is sandwiched within the second locking chamber between the second hook and the second frame member.

2. The screen panel of claim 1, wherein each of the first hook and second hook defines an elongated spine such that a hook length of the first hook is substantially equal to a frame member length of the first frame member and a hook length of the second hook is substantially equal to a frame member length of the second frame member.

3. The screen panel of claim 1, wherein the first hook defines a hook length that is less than a frame member length of the first frame member and the second hook defines a hook length that is less than a frame member length of the second frame member.

4. The screen panel of claim 1, wherein the screen frame further comprises an elongate third frame member and an opposed elongate fourth frame member, wherein a first spline couples the screen mesh to the third frame member in the unrolled configuration, and a second spline couples the screen mesh to the fourth frame member in the unrolled configuration.

5. The screen panel of claim 1, wherein the first hook further defines a first upper wall configured to cover the first opening and the second hook further defines a second upper wall configured to cover the second opening.

6. The screen panel of claim 1, wherein the screen mesh is rolled around itself between the first end portion and the second end portion in the rolled configuration.

7. The screen panel of claim 1, wherein the screen mesh is rolled around a tube between the first end portion and the second end portion in the rolled configuration.

8. The screen panel of claim 1, further comprising a shipping container, wherein the screen frame, screen mesh, first hook, and second hook are received within the shipping container.

9. The screen panel of claim 1, wherein:

the screen frame further comprises a third elongate frame member; and the screen mesh is unattached to the third elongate frame member in the rolled configuration.

10. The screen panel of claim 1, wherein the screen frame comprises a plurality of elongate frame members, wherein the first frame member comprises a frame wall positioned on a distal end of the first frame member, wherein a central portion extends between a first end and a second end of the frame wall, wherein a hooked tab is formed on the second end such that a hooking element of the hooked tab is spaced from and overlies the central portion of the first frame member, wherein a locking tab is formed on and extends away from the central portion of the first frame member, and wherein the locking tab is spaced from the hooked tab a predetermined distance.

11. The screen panel of claim 10, wherein the hooked tab, the locking tab, and the central portion of the first frame member cooperate to define the first locking chamber, and wherein the first opening is defined between the hooking element and the locking tab.

12. The screen panel of claim 11, wherein the first curved leg extends away from a central portion of the upper wall, wherein a hooking member of the first curved leg is spaced from and overlies the upper wall and a gap is defined between a portion of the first curved leg and the upper wall, and wherein the first curved leg is sized and shaped to correspond to the size and shape of the first locking chamber.

13. The screen panel of claim 12, wherein the first curved leg of the first hook engages the first locking chamber with the hooking element of the hooked tab positioned in the gap defined between the first curved leg and the upper wall.

* * * * *